United States Patent [19]

Nourse

[11] 4,041,645

[45] Aug. 16, 1977

[54] WINDOW CONTROL DEVICES

[76] Inventor: Jack T. Nourse, Rte. 1, Box 68C, Chisago City, Minn. 55013

[21] Appl. No.: 586,633

[22] Filed: June 13, 1975

[51] Int. Cl.[2] ..... E05F 11/04

[52] U.S. Cl. ..... 49/347; 49/352

[58] Field of Search ..... 49/347, 348, 352, 360, 49/361, 362, 374; 74/89.13, 89.15, 89.2; 52/616, 627

[56] References Cited

U.S. PATENT DOCUMENTS

| | | | |
|---|---|---|---|
| 1,640,931 | 8/1927 | Gettner | 49/352 |
| 1,816,258 | 7/1931 | Lake | 49/352 X |
| 3,014,716 | 12/1961 | Hitzelberger | 49/352 X |
| 3,261,113 | 7/1966 | March | 49/361 X |
| 3,402,084 | 9/1968 | Jacobi et al. | 52/616 X |
| 3,653,156 | 4/1972 | Horgan, Jr. | 52/627 X |

FOREIGN PATENT DOCUMENTS

| | | | |
|---|---|---|---|
| 568,865 | 4/1924 | France | 49/352 |

*Primary Examiner*—Philip C. Kannan

*Attorney, Agent, or Firm*—Dugger, Johnson & Westman

[57] ABSTRACT

Window controls for controlling large window units to permit the windows to be mechanically raised and lowered for ventilation purposes in a reliable, efficient, and low cost manner. The controls include means for automatically locking the window units against intrusion, when the windows are closed or partially open, and further the window controls are simplified by providing edge mounting frames for the glass only at the top and bottom edges of the glass. In some forms of the invention, where it is desired, the windows can carry automatically positionable screens for screening the vent openings.

15 Claims, 15 Drawing Figures

WINDOW CONTROL DEVICES

BACKGROUND OF THE INVENTION

1. Field of the Invention

The present invention relates to control systems for raising and lowering window units.

2. Prior Art

In the prior art, various devices comprising means for opening and closing windows in a mechanical manner have been advanced. For example, U.S. Pat. No. 1,816,258 shows a crank operated means for opening and closing windows, but one which operates in a much different manner. The unit uses a pulley arrangement which increases the speed of operation of the cable, and thus decreases the mechanical advantage of the operator. While a pulley arrangement is used in some instances in the present device, the intent is opposite, that is in the present device pulley arrangements are used to increase the mechanical advantage for lifting heavier windows. Likewise, the gear box utilized in the present invention is designed to be low cost, and adaptable to a wide variety of different types of installations.

U.S. Pat. No. 2,547,196 shows a type of a latch for an overhead door that will automatically latch and prevent the door from being opened, and when a particular chain is under tension the door may be raised. A somewhat similar type of lock for a window guard is shown in U.S. Pat. No. 1,592,932.

U.S. Pat. No. 288,282 shows an early form of a self-storing screen for a window that can be raised and lowered, and also a similar device is shown in U.S. Pat. No. 441,088.

My U.S. Pat. No. 3,755,967 shows a hydraulic window operator used for raising and lowering glass units.

SUMMARY OF THE INVENTION

The present invention relates to a mechanical window operator for use with window sashes or units of a wide range of sizes that is crank operated, small in size, easily installed, and reliable in operation. The operator unit includes bevel gears for a right angle drive so that the crank can be rotated in a plane parallel to the wall in which the window is installed. The gears are used to drive a threaded rod having a follower nut that in turn directly controls a cable. The cable is used either to directly lift the window in certain installations, or where space or other requirements are not suitable, the cable controls a rod to directly lift the window.

Automatic security locks can be provided. The locks are actuated by cable tension and will prevent unwanted access to the room in which the window is used whether the window is closed or partially open.

The actuator and vent is of size to be used in any building frame, and no special window framing system or reinforced walls are required. The forces are parallel to all frame sections for strength and rigidity. Operating the window units is easy and foolproof. The operating units are low cost and simple so they can be made with unskilled labor. Maintenance is also very simple.

The points of wear and thrust of the operators are supported by suitable bushings or thrust bearings for reliability.

DESCRIPTION OF THE PREFERRED EMBODIMENTS

Figure 1A:
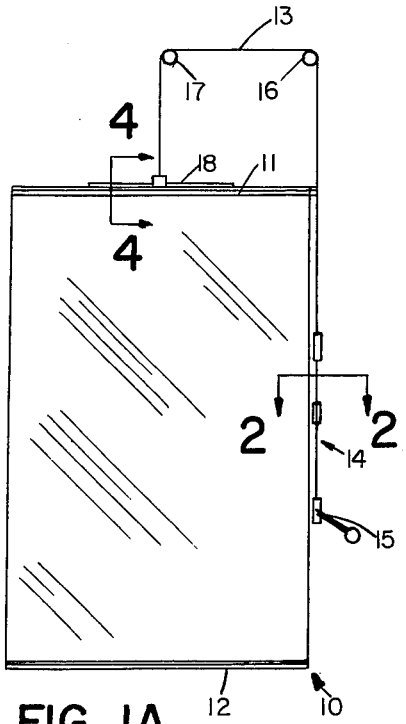
FIGS. 1A, 1B and 1C are schematic representations of typical windows utilizing operators made according to embodiments of the present invention.

Referring first to FIG. 1A, for a general overall view of a typical window control system of the present invention, a window sash or unit illustrated generally and schematically at 10 as shown has an upper cross frame member 11 attached thereto, and a lower case frame member 12. In addition, there is an operating cable 13 controlled through an operator mechanism 14 positioned alongside the window. It is to be understood that the window is slidably mounted in a frame mounted in a building wall for vertical movement so that the bottom portion of the window can be raised to provide a vent to the exterior. The operator mechanism 14 is positioned along the side of the window, and includes an operator crank 15 that protrudes into the interior of the building for operation.

The cable 13 is mounted over a first pulley 16 and over a second pulley 17, which are both rotatably mounted in the building wall above the window unit. The cable extends down to be connected to a load distributing channel 18 that is attached to the top frame 11 of the window. As can be seen, the window glass has no side frames attached thereto. The glass unit will slide in fixed vertical frame members or guides that are mounted in the building walls as will be shown in the more detailed drawings.

Figure 1B:
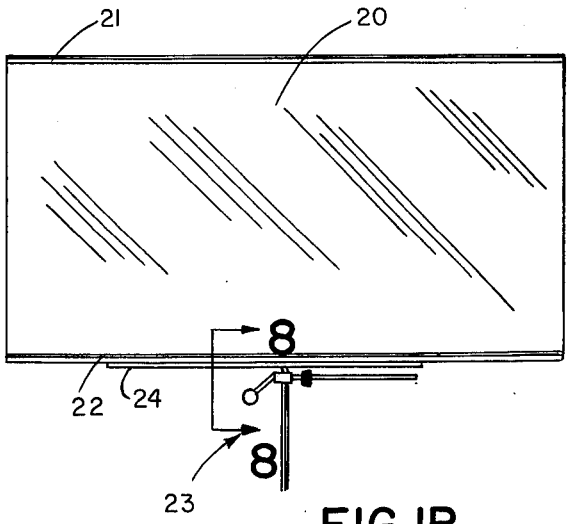

A second form of window control is shown in FIG. 1B. The window unit 20 comprising a double pane of glass is held by an upper cross frame member 21, and a lower cross frame member 22 which holds the glass panes together, and as shown, again, the window has no side frames attached directly to the glass. In this form of the invention, an actuator 23 is positioned below the lower edge of the window and is mounted with respect to the walls of a building in which the window is installed. The actuator is crank operated and includes means for pushing on the window to lift the window through a load distribution channel or bar 24 attached to the bottom frame member 22. Again, the window will slide vertically in suitable fixed guide frames. No exterior frame members are attached along the sides of the glass.

Figure 1C:
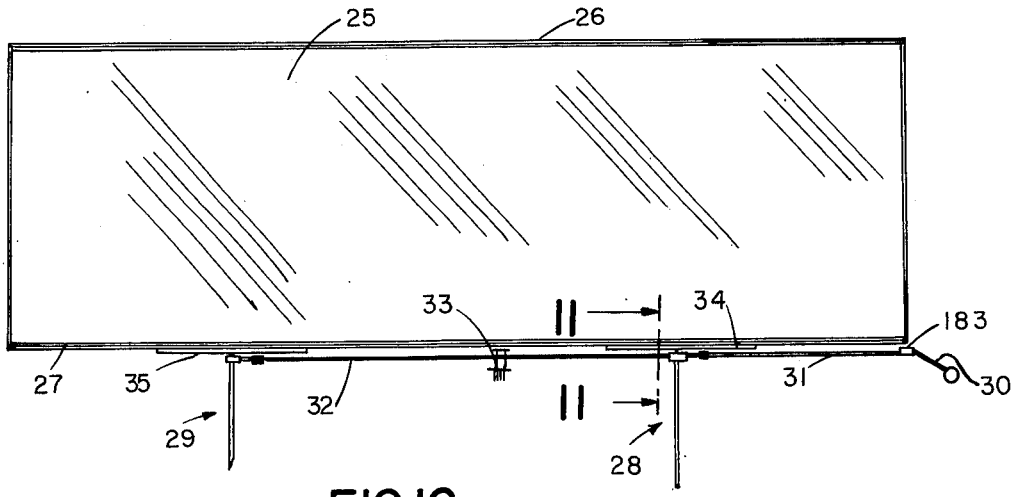

A third form of window control is shown in FIG. 1C, where a substantial window width is provided. As shown, the window unit 25 includes an upper cross frame member 26 and the lower cross frame member 27. There are two actuators used for lifting the window unit as indicated at 28 and 29, respectively. A crank 30 is operated through right angle gear box to drive a shaft 31 which has at least one threaded portion which actuates and drives the first actuator unit 28. A connecting shaft 32 is connected to the drive of first unit 28 and is mounted through a suitable center bearing 33, which may be mounted to the wall in which the unit is attached. The shaft 32 drives a screw threaded member of a second actuator unit 29 which is substantially identical in operation to the first unit. Load distribution channels or bars 34 and 35 are used for the respective units to distribute the load along the bottom frame 27 so that the window can be raised for ventilation, if desired.

The schematic showings in FIGS. 1A, 1B and 1C are to provide an overall schematic showing and it is to be understood that the window units will be raised in vertical direction for permitting air to enter the buildings if desired. The operators all are manual crank operated and therefore reliable and safe.

Figures 2, 3:
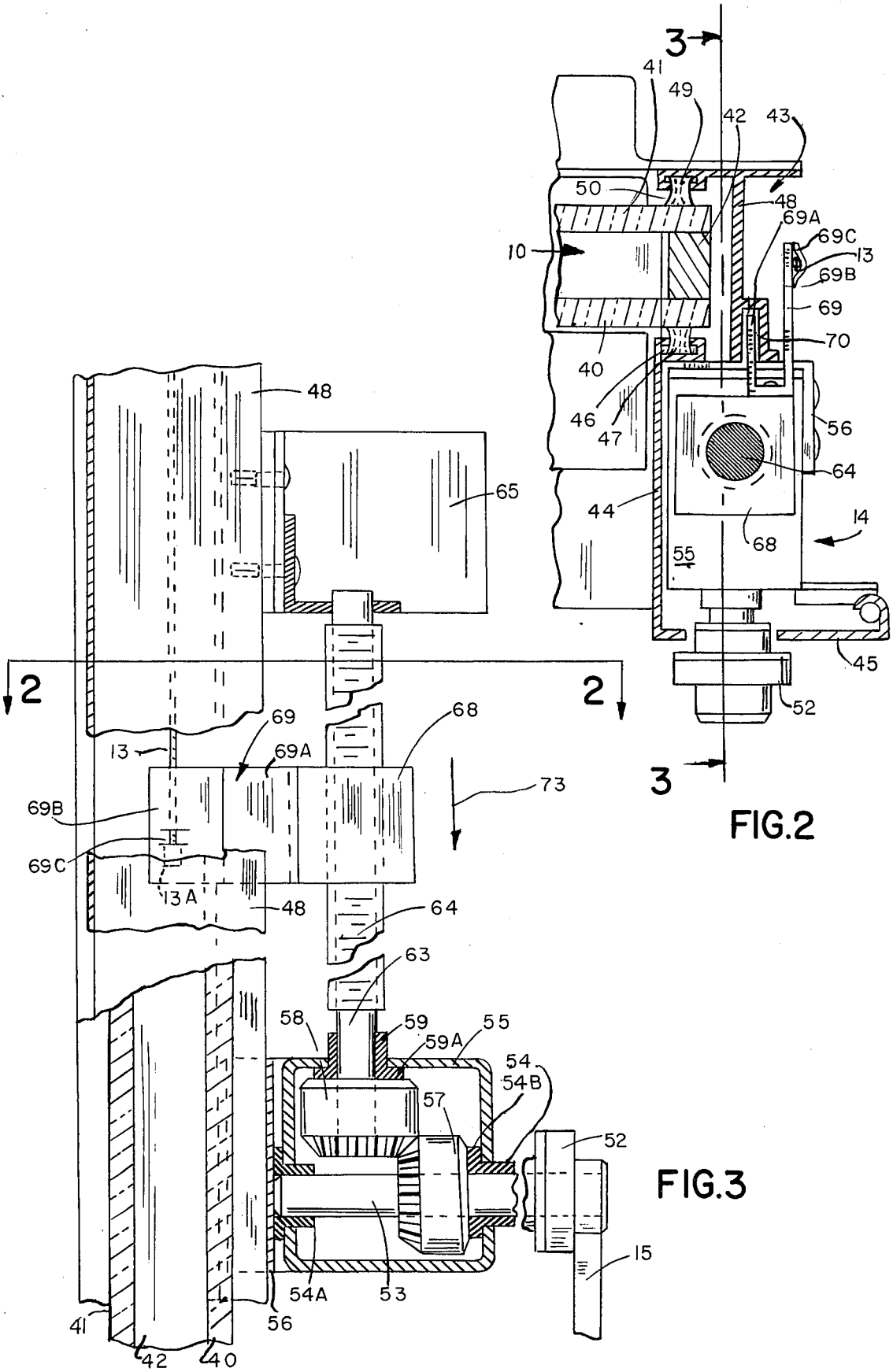
FIG. 2 is a sectional view taken as on line 2—2 in FIGS. 1 and 3.
FIG. 3 is a sectional view taken as on line 3—3 in FIG. 2 with parts broken away, and rotated to orient the the unit in vertical direction.

Now, referring specifically to FIG. 2, a sectional view of the typical operator 14 is shown. The window unit 10, as shown is comprised of a pair of glass panes 40 and 41, which are sealed with a suitable divider 42 in the usual manner to form an insulated glass window. This shows an upright side edge portion of window unit. As shown, the glass panes are not directly mounted in fixed metal frames adjacent their side edges.

The side edge of the window unit is slidably mounted in a fixed framework indicated generally at 43 that is mounted onto a suitable building wall, and fastened in place in any desired manner. The framework 43 is made of a number of extrusions, and as shown includes a first member 44 that is on the side of the wall toward the interior of the house, and has a front face panel 45 that is on the interior of the room or house. The panel 44 extends toward the window glass, and includes a channel member 46 which in turn is used for mounting suitable weather stripping material 47 that seals against the glass pane 40 so it will permit the glass to slide vertically while still maintaining an adequate weather seal. A second frame member 48 is also utilized and is held in place in a suitable manner. The frame member 48 includes a channel member 49 that holds the second piece of weather stripping 50 to seal against the opposite glass pane 41 and permit the glass to slide in vertical direction. These two members 48 and 44 can be fastened together with suitable clips, rivets or other fastening devices.

Referring now specifically to FIG. 3, which is a vertical sectional view with parts broken away and with the lower portion showing the window panes in cross section, the window operator includes the crank 15 that is mounted through a suitable friction clutch schematically shown at 52 to drive a shaft 53. The shaft 53 is mounted in suitable bearings 54 in a housing 55 that in turn is fixedly attached through a suitable bracket or clip 56 to the first frame member 44. A second bearing 54A is used for mounting the opposite end of the shaft in the housing 55. The shaft 53 drivably carries a right angle gear 57, that in turn drivably engages a second gear 58 mounted against a bearing 59 that also in turn is mounted in the housing 55. It should be noted that both bearing or bushings 54 and 59 have thrust flanges 54B and 59A that carry the thrust from the gears directly to the housing, and provide adequate wear surfaces.

The gear 58 is drivably attached to a shaft portion 63 of a screw threaded drive member 64. The screw threaded drive member extends vertically upwardly along the lateral side of the window unit 10. The screw 64 has an end member rotatably mounted in a suitable bracket 65 that in turn is attached to the frame assembly 43. As shown, the bracket 65 may be attached to one edge of member 48 and also to the building wall. This bracket rotatably supports the screw 64 in position adjacent to the frame assembly 43. The screw 64 has a screw follower 68 threadably mounted thereon, which is mounted for threadable movement along the screw as the screw is rotated. The screw itself is a "quad" lead screw, which is known in the art, but is made so that follower 68 travels axially approximately ½ inch for each revolution of screw while still keeping the force required for driving the screw relatively low. All screw drives shown herein utilize the "quad" lead screw.

The follower 68, as shown, has a bracket 69 attached thereto. The bracket 69 has two legs. A first of the legs is indicated at 69A and it slidably fits within a provided slot 70 that is formed at the outer edge of the vertical frame member 48. The interlocking of leg 69A and slot 70 prevents the bracket member 69 and follower 68 from rotating with the screw 64 when the screw is driven. At the same time, however, the leg 69A is permitted to slide vertically along the slot 70 so that the follower 68 (and bracket 69) can move axially along the screw. The second leg 69B of the bracket 69 extends parallel to leg 69A. That is, toward the outside wall, and has a small offset section indicated at 69C defining a slot through which the control cable 13 passes, and a suitable cable fitting 13A can be used for preventing the cable from slipping out of the slot past the offset 69C. The cable is held in the bracket 69 so that it can carry tension.

The cable 13 as shown is mounted over the pulleys 16 and 17 and connects to the window unit and as the follower 68 is operated by turning the crank to move the follower in direction as indicated by the arrow 73, the tension in the cable 13 will be exerted on the carrying member 18, to lift on the window unit and cause the window unit to slide upwardly. This opens the window. The crank may be reversed to permit the window unit to lower under gravity.

Figure 4:
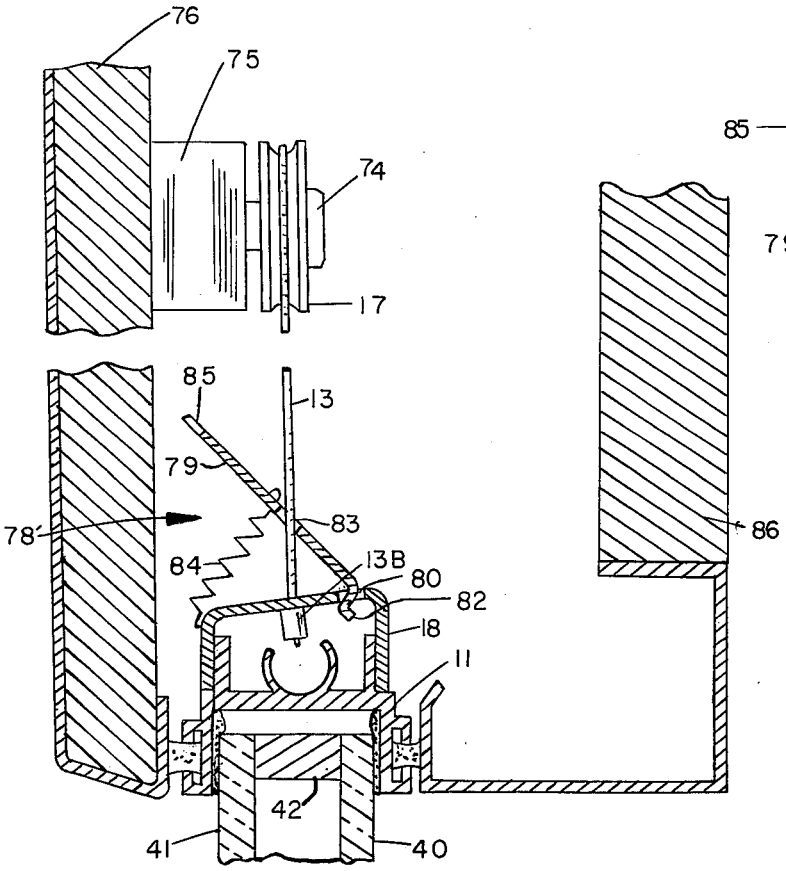
FIG. 4 is a sectional view taken as on line 4—4 in FIG. 1A.
Figure 5:
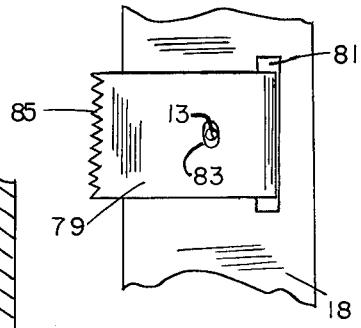
FIG. 5 is a fragmentary top plan view of the device in FIG. 4.

Referring specifically to FIGS. 4 and 5, the pulley or sheave 17 as shown is mounted on a pin 74, that is attached through a suitable block 75 to the building exterior wall 76. The cable 13 also has a fitting 13B at the opposite end thereof. The cable 13 passes through a provided opening in the load distribution channel 18, which in turn is fixed to the upper window frame member 11, so that the fitting 13B will permit the cable to exert force on the upper wall of the load distribution channel 18 and lift the channel and the window unit when the cable 13 is caused to be under tension by movement of the screw follower 68. It can also be seen that the glass panes 40 and 41 are attached to the top frame 11 by adhesives shown schematically. There are no side frames attached to the panes, as previously stated.

The cable 13 also passes through a locking device indicated generally at 78, and as shown, the locking device includes a generally flat strap 79 which has an offset section 80 that passes through a provided slot 81 in the upper wall of the channel shaped load distribution member 18. A lip 82 is formed at the end of the offset to prevent the strap from slipping out of the opening easily. Thus the member 79 is in effect pivotally mounted in the slot 81 through the offset section 80 and the lip 82. The strap 79 has an opening 83 therethrough through which the cable 13 passes. A lightweight spring shown schematically at 84 is connected between the strap 79 and the load distribution channel 18, to tend to exert a force attempting to pull the strap 79 toward the load distribution channel 18. The strap 79 can have serations or teeth indicated at 85 defined in the end thereof opposite from offset 80, and when the cable 13 goes slack, the spring 84 will bias or urge the end of the strap 79 having teeth 85 thereon toward the adjacent surface of the wall 76. Once the teeth 85 engage the wall 76, any attempt to raise the window unit manually by prying on the bottom frame, or in any other way attempting to raise the window without causing tension in the cable 13, will cause the teeth 85 to dig into the wall 76 and prevent the window from being opened.

As soon as the cable 13 is under sufficient tension, it will bear against the edges of the opening 83 and pivot the strap 79 against the action of the spring 84 so that the window can be raised when the cable 13 has tension. It should also be noted in FIG. 4 that the frame for the window would include members that would attach to the interior wall 86. These details of finishing are well within the skill of people working in the field and thus are largely omitted from the drawings or are shown only schematically.

The perimeter frames used in all forms of the invention are made in sections so they may be installed.

Figure 6:
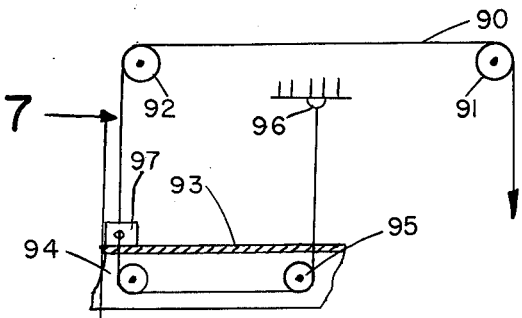
FIG. 6 is a schematic representation of a modified form of the window lifting arrangement shown in FIG. 1A utilizing a force multiplication pulley arrangement.
Figure 7:
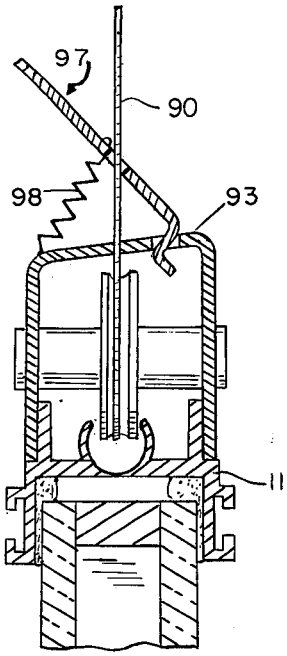
FIG. 7 is a sectional view taken as on line 7—7 in FIG. 6.

Referring specifically to FIGS. 6 and 7, a modified form of the window lifting device shown in FIG. 1A is illustrated, together with a similar lock mechanism. In this form of the invention, the force exerted to lift the window is twice the tension in the cable, neglecting friction. As shown schematically, a cable 90 is mounted over a first pulley 91, a second pulley 92, and then extends downwardly to a load equalizer assembly 93 that mounts first and second pulleys indicated at 94 and 95. The cable 90 then passes up through openings in the equalizer assembly 93 and is dead-ended as at 96 to a portion of the building wall, or a block supported from the building wall. In this way, the tension in the cable 90 is doubled to lift the window unit to which the equalizer bar 93 is attached.

Referring specifically to FIG. 7, a lock strap assembly illustrated at 97 is operable in the same way as the one previously in that the strap has an offset end portion which passes through an opening in the equalizer bar assembly 93, and a spring 98 loads the lock strap 97 as in the previous form of the invention.

The lock strap will work in the same manner as previously described, and once the tension in the cable 90 has been released, the lock strap will prevent raising of the window unit by engaging the wall as shown previously. When the cable tension is again present in the cable, the cable will lift the lock strap 97 away from the wall to release it. The use of a cable arrangement as shown in FIG. 6 doubles the available lifting force without increasing cable tension.

Figure 8:
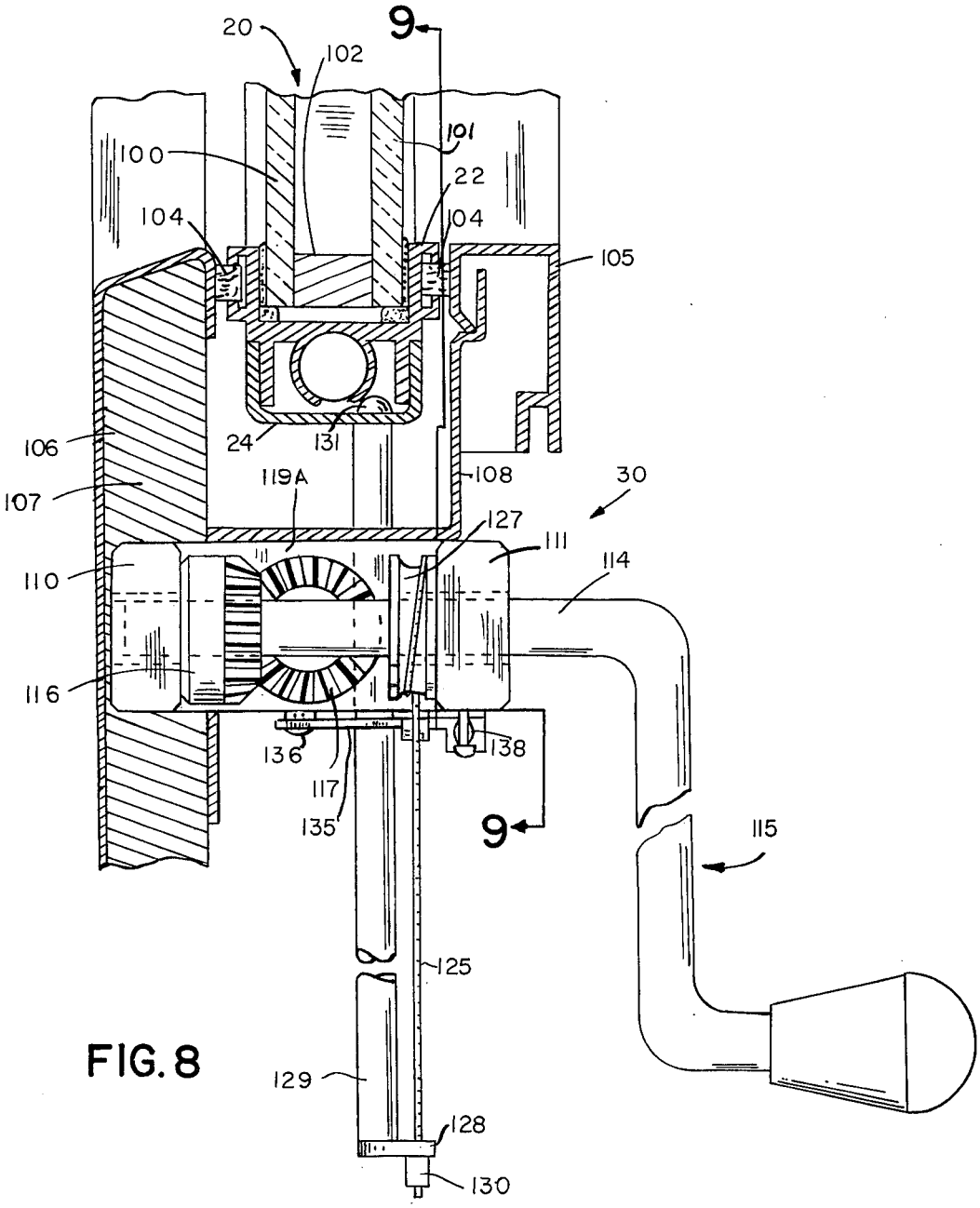
FIG. 8 is a sectional view taken as on line 8—8 in FIG. 1B, showing a modified form of the present invention.
Figures 9, 10:
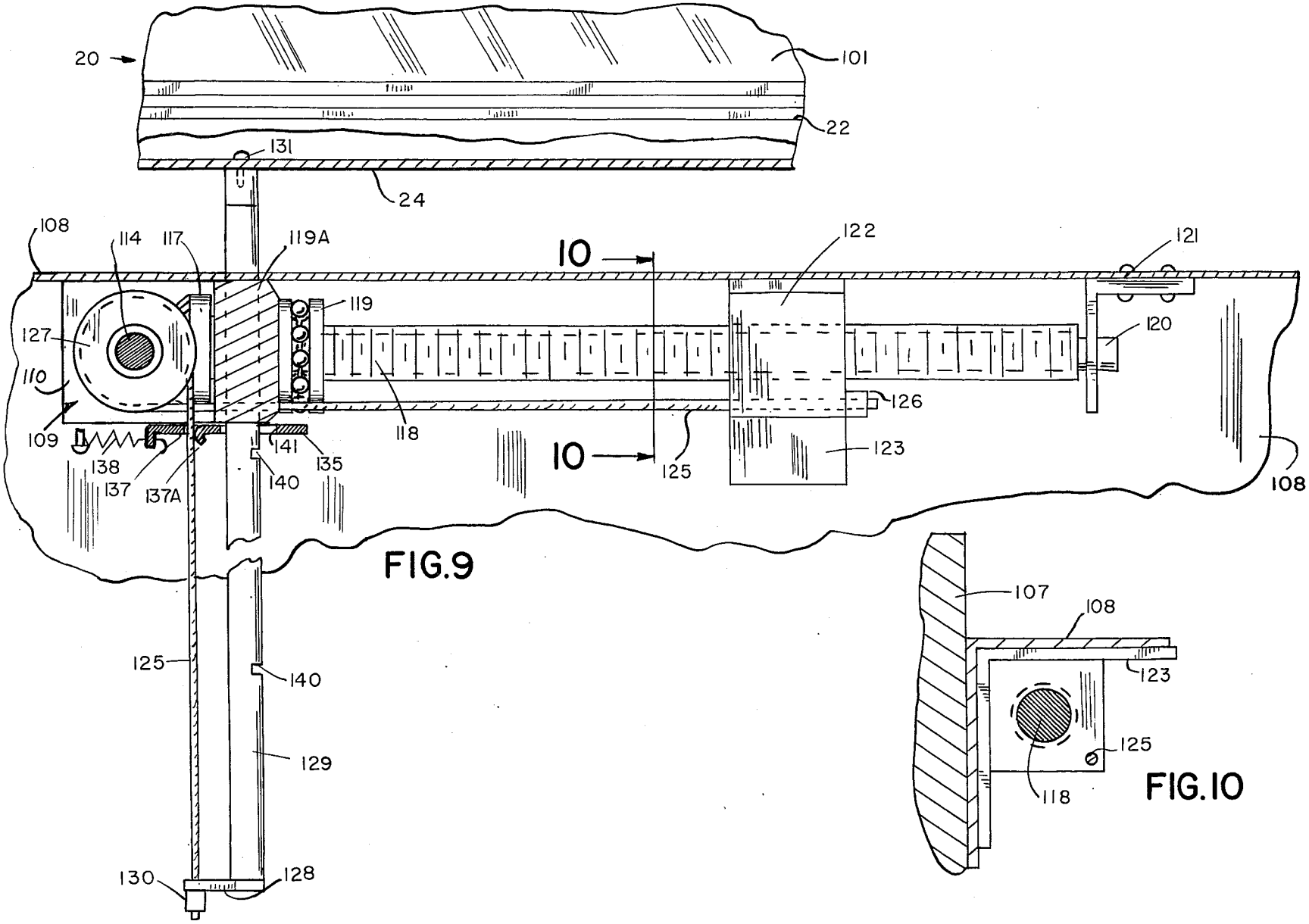
FIG. 9 is a sectional view taken generally along the line 9—9 in FIG. 8.
FIG. 10 is a sectional view taken as on line 10—10 in FIG. 9.

Referring to FIGS. 8, 9 and 10, a modified form of the invention is shown. FIG. 8 is a form of the actuator 23 shown in FIG. 1B, and the view is taken along the bottom edge of the window, as shown by line 8—8 in FIG. 1B.

The window unit 20 includes glass panes 100 and 101, as previously mentioned, that are sealed onto a strip 102 to form an insulated glass unit. The lower frame member 22 as shown mounts the edges of the glass panes, but there is no metal or other frame along the vertical side edges of the glass, there being frame members only at the top and bottom. The frame member 22 includes holders for suitable sealing strips 104, on opposite sides of the glass panes to provide for weather seals at the bottom of the window unit.

The strips 104 seal against turned over lips on an interior frame member 105, and an exterior frame member 106 which forms part of the outer building wall 107. The frame includes a third member 108 as shown that is attached to the outer wall in a suitable manner, and also is attached to the frame member 105 to form a complete lower frame, that may be fixed to the building interior wall in a desired manner.

At a desired location near the midportion of the window unit in horizontal direction the load equalizing channel 24 is attached to the frame member 22. A suitable gear box assembly illustrated generally at 109, is mounted to the laterally extending portion of the frame member 108, as perhaps best seen in FIGS. 8 and 9. The gear box is a horseshoe or U shaped member that forms spaced side bearing blocks 110 and 111, adjacent the exterior wall 107 and the interior wall, respectively joined by a base block 119A. The U shaped member is mounted to the housing in any desired manner and as shown in FIG. 8, the open end is seen. The base block 119A holds the side blocks 110 and 111 in position. Thus the gear box assembly is held securely, and is supported by the walls of the building and the members forming the stationary lower window frame.

As shown, the side block 111 mounts a shank portion 114 of a crank assembly 115, and the shank extends horizontally across the gear box and is rotatably mounted in the side bearing block 110 as well. A first bevel gear 116 is drivably mounted on the shank adjacent the side block 110. The gear 116 drives a second bevel gear 117 that in turn is drivably mounted onto an end portion of a threaded shaft or screw 118. The shaft or screw 118 extends horizontally outwardly from the base of the gear box. A thrust bearing assembly 119 is provided between a shoulder on the screw 118 and the end of base block 119A of the gear box to carry thrust from the screw to the gear box. The gear 117 is positioned against the block 119A on the interior of the gear box. The thrust bearing assembly 119 carries the thrust load to the gear box and without causing freezing, scoring, or galling of the parts.

The screw 118 extends a desired distance horizontally, and has an end portion 120 that is rotatably mounted and suitably supported in bearings, if desired, with respect to a bracket 121 that in turn is fixed to the horizontal wall of the window frame member 108 with suitable rivets or screws. A traveling threaded block or screw follower 122 is threadably mounted on the screw 118, and as shown in FIG. 10, the block has a slider bracket 123 fixed thereto which is in the shape of an angle iron, and has one leg that slides against the undersurface of the horizontal section of the frame member 108, and another leg that slides against the vertical portion of that frame member 108 so that the follower is prevented from rotating with screw 118. The follower can slide longitudinally along the surfaces of the bracket 108 as the screw 118 is rotated.

A cable 125 passes through an opening in the block 122, and a cable end member 126 fixed to the cable permits the cable to carry tension without slipping out of the block. The cable 125 extends back toward the gear box, and through a provided opening in the wall of the box, and then is passed up over a pulley member 127 that is rotatably mounted over the shank 114 of the crank in a suitable bushing, so that the pulley will rotate with respect to the crank. The crank 114 does not drive the pulley 127. The cable 125 is looped over the pulley for substantially 270° of wrap, and extends straight downwardly as shown in FIGS. 8 and 9, and passes through a provided opening in the lower wall of the gear box. As shown, the cable passes through an opening in a small ear or tab 128 that is fixed to the lower end of a push rod 129. A cable fitting 130 is used to retain the cable with respect to the ear 128. The rod 129, as shown, passes upwardly through the block 119A of the gear box. The block 119A provides a sliding guide for the rod. The rod extends through a provided opening in the horizontal wall of frame member 108, and is abutted against the base wall of the load distributing channel 24. The rod 129 can be held in place with respect to this channel with a suitable small cap screw or pin indicated at 131, so that the rod will not separate from the load distributing channel.

A lock lever 135 is pivotally mounted with a suitable pin 136 to the lower side of the block 119A and is provided with an opening for passage of the rod 129. In addition, a second opening 137 is provided for the cable 125, and this opening can be formed by punching partially through to round off one edge 137A to avoid wear on the cable. The outer end of the latch lever 135 is spring loaded with a spring 138, to urge the latch lever about its pivot on pin 136 so that the rounded end 137A of the opening 137 will be urged against the cable 125. When the cable is under tension, the latch lever 135 will be held in its position as shown in FIG. 9, and the rod 129 will be free to slide axially through the provided opening in this latch lever 135.

However, as shown, the push rod 129 has spaced notches 140 defined therein which are of size to receive an edge portion 141 of the opening for the rod in the lever 135, and when the cable is slack, the edge 141 of the opening will ride against the push rod 129 under spring force and whenever the push rod 129 reaches the position where one notch 140 and the edge portion 141 align, the edge portion 141 will enter one notch and will prevent the push rod 129 from being moved until the cable is under sufficient tension to push the latch lever about its pivot pin 136 so the edge portion 141 again clears the notch.

In this way, a safety lock is achieved so that external force tending to lift the window cannot accomplish the lifting action because the cable will be slack and the latch lever 135 will pivot under the spring force so that the edge portion 141 of the opening for the push rod will enter the push rod notch 140 and lock the window in position.

The cable pulls directly on the push rod, and moves on a 1 to 1 basis with the block 122 as it is threaded along screw 118. Screw 118 is a quad lead screw, affording adequate movement of the block 122 for each revolution of the screw without motion increasing pulley sets.

Figure 11:
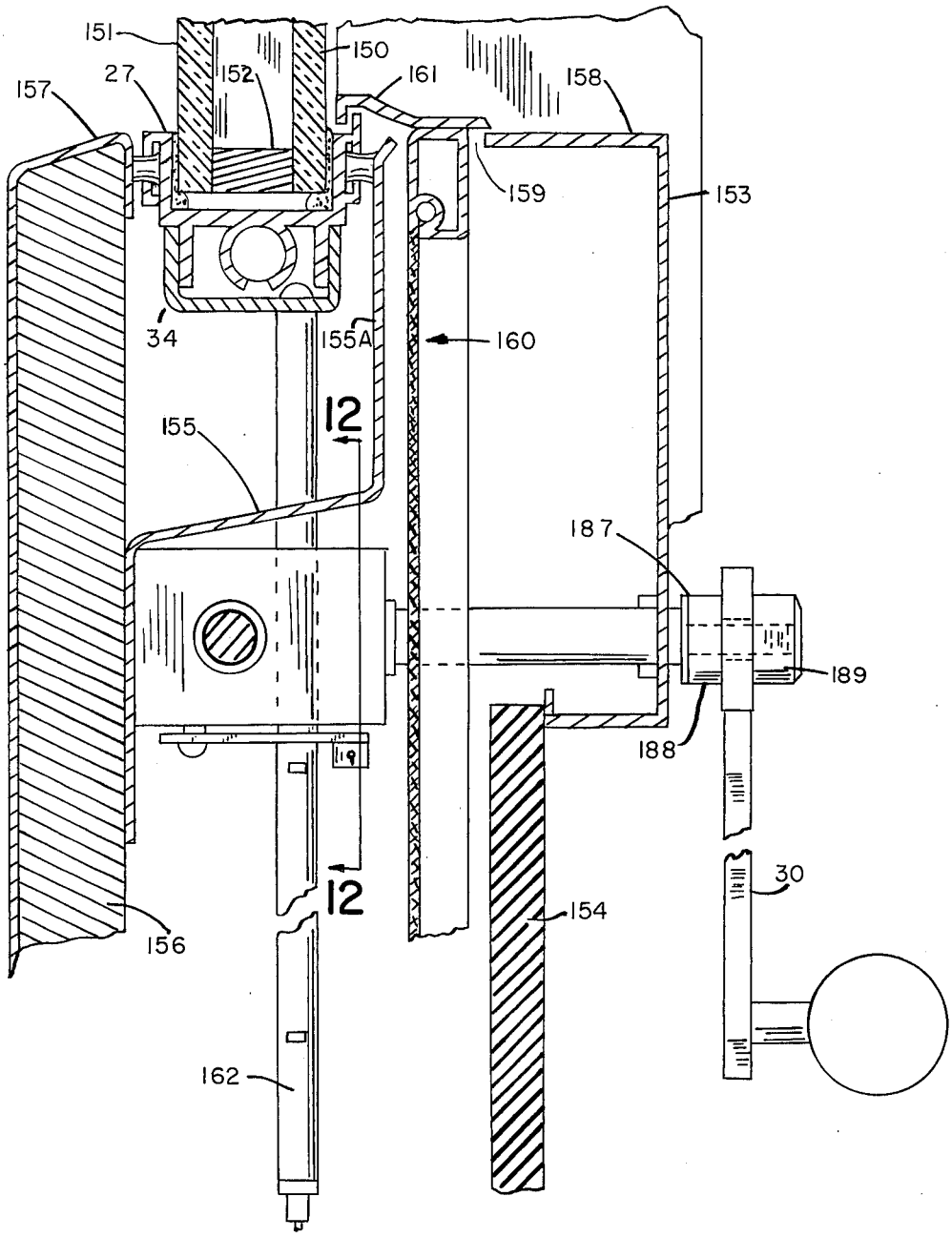
FIG. 11 is a sectional view taken as on line 11—11 in FIG. 1C.
Figure 12:
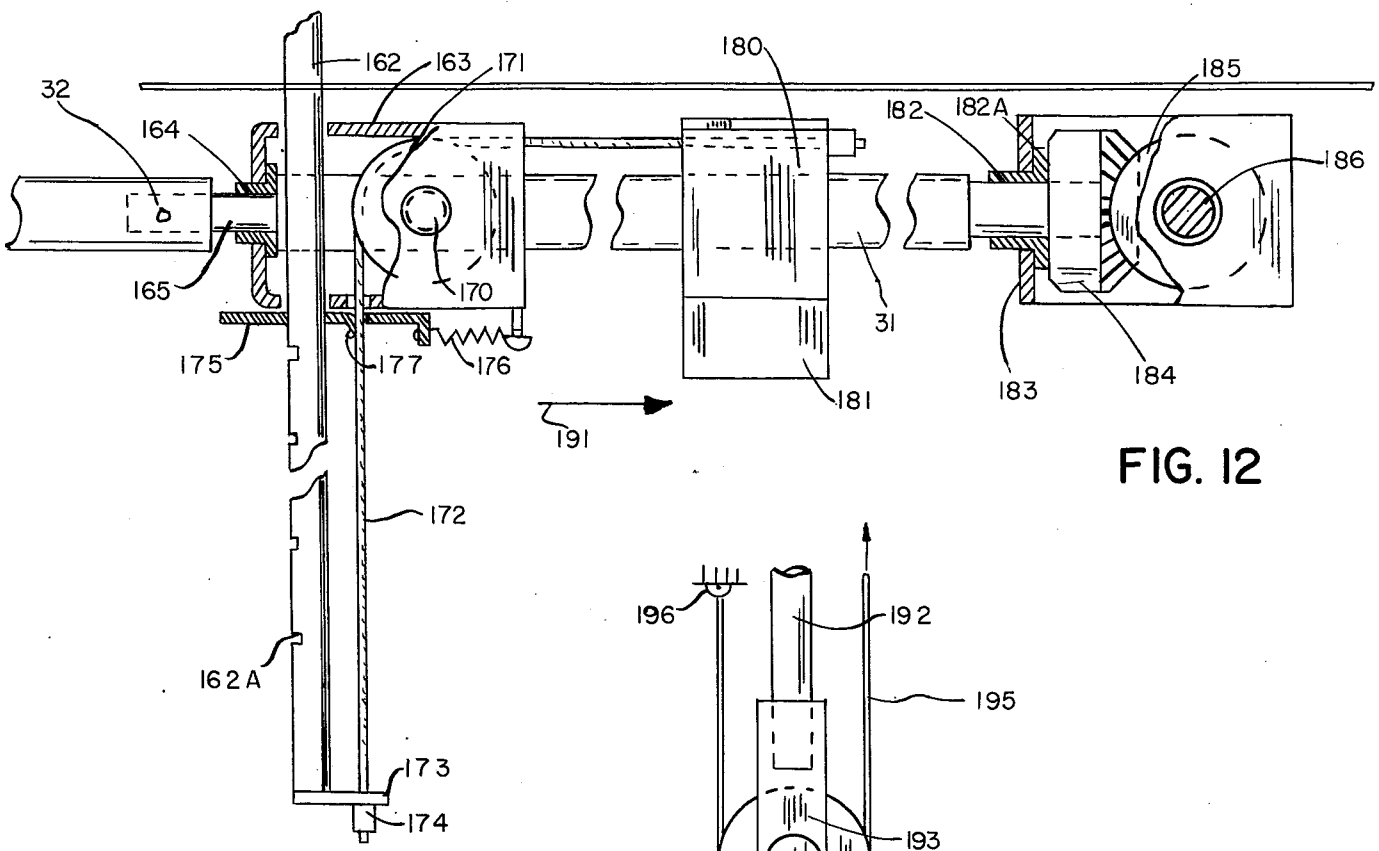
FIG. 12 is a sectional view taken as on line 12—12 in FIG. 11.
Figure 13:
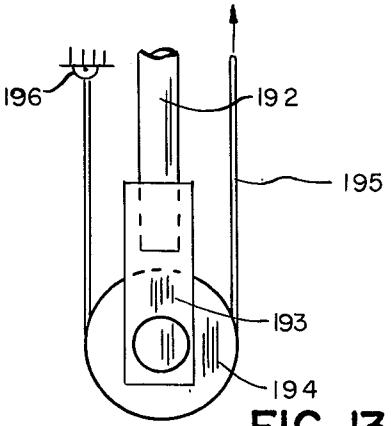
FIG. 13 is a part schematic representation of a modified form of an actuator device used with the present invention.

Referring now to FIGS. 11, 12 and 13, a further modified form of the invention similar to that shown in FIGS. 9, 10 and 11 is illustrated. The form of the invention shown in FIGS. 11, 12 and 13 operates on the same lift-push rod principle as that shown in FIG. 9, but is used in connection with wider window units where more than one push rod may be necessary. Utilization of a plurality of push rods actuated simultaneously is disclosed, and series shafts extending from the crank right angle gear box to the individual push rod units are used.

In FIG. 11, the lower frame member 27 is used to mount panes of glass indicated at 150 and 151, respectively, separated by and fastened to a spacer strip 152. Suitable weather stripping can also be mounted in this unit, and as shown the outer frame can include an outer member 153 that is supported with respect to an interior wall shown fragmentarily at 154, and held in place in a suitable manner. The frame assembly also includes an interior member 155 that extends transversely across the width of the window unit, and is mounted to an exterior wall 156. A frame portion 157 is also mounted on the exterior wall. The frame member 153 has an upper flange 158 that forms an interior sill, and in combination with an upright extending portion 155A of the member 155, defines an opening 159 into which a screen assembly 160 is positioned. The screen assembly 160 is attached to the lower window frame member 27 through a bracket or clip member 161, and will move vertically with the window. The screen therefore is stored behind the inner wall 154, and the frame member 153 when the window is in its position as shown in FIG. 11, but the screen will be raised with the window when the window is raised to screen the vent opening.

As shown herein, the reinforcing or load distributing channel 34 is fixed to the frame member 27, and a push rod 162 is attached with a suitable cap screw or other connector to the bottom or base wall of this channel 34. The push rod 162 extends through provided openings in a housing 163 that is mounted to the bracket 155 in a suitable manner, and as shown, this housing 163 has a wall which mounts a bearing 164 to rotatably support one end 165 of a threaded shaft or screw 31 which forms the drive screw for one push rod unit used with this window unit. The bearing 164 is a thrust bearing to carry the thrust from the screw 31.

In this form of the invention, the end portion 165 of the drive screw is also drivably coupled to a laterally extending shaft 32 that extends over to the second push rod unit 29 shown in FIG. 1C. This drive coupling will cause the shaft 32 to rotate whenever the screw 21 is rotating. The shaft 167 can drive a screw for the push rod unit 29. In addition, the housing 163 has a wall that mounts a pin 170 to rotatably support a pulley 171 for a control cable assembly 172. The control cable passes downwardly through an ear 173 attached to the push rod 162, and a cable fitting 174 is provided to retain the cable on this gear. The housing also carries a pivoting lock dog 175 that has a spring control 176 operable in the same manner as the previous form of the invention (note the curved section 177 that rides against the cable 172). The cable extends over the pulley 171 and is mounted in a traveling threaded block 180 that is threaded onto screw 31, and the threaded block as shown has a member 181 that bears against the vertical wall of bracket 155, so that block 180 will not rotate when the screw 31 is rotated but will slide in axial direction. The opposite end of the screw from the housing 163 is rotatably mounted in a bushing 182 that has a thrust collar 182A, and the bushing is mounted in a gear box housing 183 that in turn is also attached to the vertical portion of the frame 155. This gear box can be positioned to the lateral side of the window as shown in FIG. 1C, and is indicated generally at 183 in that figure as well.

A bevel gear 184 is drivably mounted to drive the screw 166, and bears against the thrust collar 182A of the bushing 182, and the gear 184 is driven by a second gear 185 that is also mounted in the gear box. The gear 185 is drivably mounted onto a shaft 186 that extends at right angles to the screw 31, and is mounted in suitable thrust bearings in the gear box 183. This shaft 186 forms a part of the crank assembly 30, and as shown, the shaft 186 has a flange or washer 187 drivably mounted thereon, and a friction block 188 is used to transfer force from the crank 30 to the washer 187, and thus to the shaft 186. The crank 30 has a flat portion that is urged against the friction material 188 with a nut 189, and suitable springs for take-up can be provided, such as Belleville washers between the nut 189 and the crank member 30. The crank 30 is rotatable with respect to the end portion of the shaft 186, so that the drive is through the force limiting slip clutch to the shaft 186.

When the crank 30 is rotated, and drives through the friction block 188, the gear 185 is rotated, thus driving the gear 184, and rotating the shaft 31.

Because the traveler block 180 is prevented from rotation by the flange or member 181, it will travel along the screw 31, pulling directly on the cable 172 when it is moved in the direction as indicated by the arrow 191, causing the cable to lift on the ear 173 and lift the push rod 172 to push against the channel 34. At the same time, the shaft 32 is rotated to actuate the actuating member 29 in the same manner and lift the push rod of actuator 29. The member 29 is identical to the membr 28, and thus two push rods will be bearing against the bottom side of the window assembly at laterally spaced locations, to prevent the window from cocking to to lift it positively.

It can be seen that the screen member 160 will be raised when the window is raised to provide a screen over the opening below the window and between the window and the sill so that there is an automatic screened opening when the window unit is used for a vent.

Additional push rod units can be put in series if more than two are necessary, and of course the arrangement shown specifically in FIG. 12 can also be used for a single vertical push rod. The automatic lock member 175 works in the same manner as previously explained, and will engage the notches 162A in the push rod 162 to prevent the push rod from being lifted once the cable is slack.

Reversing the crank operation will permit the window to lower under gravity, as in the other form of the invention. The crank 30 can be removed when the unit is not to be operated by reversing nut 189 so that the window operator is very inconspicuous.

In FIG. 13, a modified form of attachment for a cable, such as cable 172, to a push rod is utilized to provide a mechanical advantage, reducing the speed of window operation, but increasing the force available. A push rod indicated generally at 192 has a U shaped bracket 193 at its lower end, and this bracket rotatably mounts pulley 194. A cable then 195 which is identical to cable 172 is passed over this pulley and is deadended as shown schematically at 196 with respect to the wall of the pulley housing or on some frame member. Then when tension is applied to the cable 195 the push rod will be lifted in the same manner as previously shown, but at one-half the rate, and with double the force. This is a simple reduction pulley that is well known in the art, but can be adapted for use with heavy units if desired.

The glass units, of course, have been shown to be double panes, but any type of glass unit can be used with the present system. Security plastics, tinted glass or tempered glass panes also can be utilized. It is of course apparent that the height of the head cavity, that is, the space above the window unit, must be equal to the amount of opening that is desired at the bottom. Likewise, the screen depth for the units that have attached screens to cover the vent opening can be selected as desired within the space available.

The aluminum extrusions are easily manufactured, and relatively low cost. Extrusions of many different configurations are presently available for window frames. The finishes can also be in accordance with accepted architectural standards.

The devices provide for simple mechanical operation, adequate weather stripping, and also can be easily provided with "weep" holes to permit escape of water that might otherwise accumulate in the window frames. For example with reference to FIG. 11, a weep hole can be provided in the wall 156 just above the horizontal panel of section 155, so that any water that might weep down into the area below the window frame would be able to drip outwardly to the exterior wall.

With safe mechanical operation, and in particular with easily adapted operator such as the pushrod operating from cables in turn controlled by a screw follower, no special construction is required, and the advantages of attractive, safe, lockable, and secure windows are available as replacement units in existing building and in buildings constructed according to normal construction techniques.

As stated previously, the unit provides a locking sash or window that is locked from further raising by any means other than the operator provided, even if the window is partially open. Thus exceptional safety is provided.

The units come in a variety of sizes and may be used for commercial, office, multi-family, motel, high rise, or other types of buildings. The units provide functional ventilation or may be used for emergency ventilation. The locking feature permits leaving the window open at night without fear of forced entry. All units may be provided with an "in swing" feature if desired to permit the window units to be cleaned.

It should be noted that both side edges of the window units are slidably mounted in identical fixed frames. The cross sections of the various forms of the frame show only one side frame for illustrative purposes.

What is claimed is:

1. An operable window assembly including a window unit, frame means for mounting said window unit for at least limited sliding movement in direction along said frame, a window unit operator mechanism comprising a screw mounted to have an axis generally parallel to the plane of the window unit, a screw follower, means acting between said screw follower and said window unit to cause movement of said window unit in a first direction when the screw is rotated and to permit movement of said window unit under gravity in a second direction including a cable member capable of carrying tension from said screw follower to said window unit, said cable being directly connected to said follower, a right angle gear drive means to drive said screw including a manual operator rotatable about an axis perpendicular to the plane of the window unit, and lock means responsive to tension in the cable to lock said window unit against movement relative to said frame in said first direction when cable is slackened.

2. A window operator system comprising a window unit, frame means mounting said window unit for at least limited sliding movement in direction along said frame, a window unit operator mechanism comprising a screw threaded member having first and second ends, a reciprocable movable member directly threadably mounted on said screw threaded member, a housing fixedly mounted with respect to the frame, the first end of said screw threaded member being rotatably mounted in said housing, means fixedly mounted with respect to said frame to rotatably support the second end of said screw threaded member, a first bevel gear in said housing drivably connected to said screw threaded member, a second bevel gear in said housing drivably engaging said first bevel gear, means to permit attaching a drive member to manually rotate said second bevel gear and drive said first bevel gear and said screw threaded member, said first and second bevel gears bearing against portions of said housing under thrust loads, means acting between said reciprocable movable member and said window unit to cause movement of said window unit in a first direction, and to permit movement of said window unit under gravity in a second direction, said means acting between including a cable member capable of carrying tension from said movable member to said window unit, said cable being directly connected to said movable member to provide 1 to 1 cable and movable member movement.

3. The combination as specified in claim 2 and thrust bearing means between said threaded member and said housing to support loads on said movable member.

4. The combination as specified in claim 2 and thrust bearing means between each of said gears and said housing to carry loads on said gears to the housing for said gears.

5. The combination as specified in claim 2 wherein said cable member is connected to said window unit without passing through motion increasing means.

6. The combination as specified in claim 2 and slip clutch means between said means to permit attaching a drive member and said second bevel gear to limit the torque applied by a drive member to said second bevel gear.

7. The window system of claim 2 and lock means responsive to tension in the cable member to lock said window unit against movement in said first direction when said cable member is slack.

8. The window system of claim 7 wherein said window system includes two relatively movable members when installed, and said lock means comprises a latch member, means to pivotally mount said latch member on one relatively movable member, bias means urging said latch member toward a lock position to engage the other relatively movable member and prevent relative movement of said relatively movable members in at least one direction, said cable member when under tension overcoming the force of said bias means to pivot said latch member away from its lock position.

9. The combination as specified in claim 7 wherein said lock means comprises a pivoting member mounted on said window unit, an opening in said pivoting member, said cable passing through said opening, said pivoting member having an outwardly extending portion engagable with means stationary with respect to a wall of a building in which said window unit is mounted, said cable and said opening being arranged so that when said cable is under tension said pivoting member is pivoted away from engagement with said means stationary.

10. The combination as specified in claim 9 and bias means tending to bias said pivoting member toward said means stationary.

11. The combination as specified in claim 2 wherein said means acting between said movable member and said window unit includes a compression carrying rod member, means to attach said cable member to said rod member whereby said cable member forces said rod member toward said window unit to move said window unit in a first direction as said cable member is loaded under tension by said movable member.

12. The combination as specified in claim 11 wherein said rod member includes a plurality of notches, and lock means comprising a lock member mounted with respect to said frame means to resist movement in a desired direction but being movable toward and away from said rod member, and being positioned adjacent said rod member, means urging a portion of said lock member to enter one of said notches and prevent axial movement of said rod member, and cable member engaging a portion of said lock member when under tension to move said lock member away from said rod member.

13. The combination as specified in claim 11, wherein said means acting between said movable member and said window unit comprises a pair of rod members spaced along the longitudinal length of said window unit and adapted to engage said window unit at spaced locations, and a common bevel gear for operating both of said rod members.

14. The combination of claim 2 wherein said window unit comprises a pair of window panes, a spacer sealed to and separating said panes, and elongated exterior frames adhesively fastened to said panes at the top and bottom of the unit only.

15. The combination of claim 14 and stationary frame means to slidably receive the side edges of said window unit, and weather strip means carried by said stationary frame means and slidably engaging said window panes.

* * * * *